US008257510B2

(12) United States Patent
Jaworowski et al.

(10) Patent No.: US 8,257,510 B2
(45) Date of Patent: Sep. 4, 2012

(54) HALOGEN-FREE TRIVALENT CHROMIUM CONVERSION COATING

(75) Inventors: Mark R. Jaworowski, Glastonbury, CT (US); Sarah Arsenault, Vernon, CT (US); James T. Beals, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/162,412

(22) Filed: Jun. 16, 2011

(65) Prior Publication Data

US 2011/0247728 A1 Oct. 13, 2011

Related U.S. Application Data

(62) Division of application No. 11/648,224, filed on Dec. 28, 2006, now Pat. No. 7,989,078.

(51) Int. Cl.
*C23C 22/68* (2006.01)

(52) U.S. Cl. ..... 148/247

(58) Field of Classification Search ..... None
See application file for complete search history.

(56) References Cited

U.S. PATENT DOCUMENTS

| | | | | |
|---|---|---|---|---|
| 4,297,150 | A | 10/1981 | Foster et al. | |
| 4,474,626 | A * | 10/1984 | Lumaret et al. | 148/259 |
| 4,497,667 | A | 2/1985 | Vashi | |
| 5,304,257 | A | 4/1994 | Pearlstein et al. | |
| 5,955,145 | A | 9/1999 | Kalvala et al. | |
| 6,217,674 | B1 | 4/2001 | Gray et al. | |
| 6,248,181 | B1 * | 6/2001 | Osako et al. | 148/247 |
| 6,312,812 | B1 * | 11/2001 | Hauser et al. | 428/412 |
| 6,485,580 | B1 | 11/2002 | Nakada et al. | |
| 6,648,986 | B1 | 11/2003 | Tang et al. | |
| 6,736,908 | B2 * | 5/2004 | Sako et al. | 148/25 |
| 6,858,321 | B2 | 2/2005 | Wada et al. | |
| 6,887,321 | B2 | 5/2005 | Parkos, Jr. et al. | |
| 7,314,671 | B1 | 1/2008 | Preikschat et al. | |
| 2005/0194574 | A1 | 9/2005 | Yamamuro et al. | |

FOREIGN PATENT DOCUMENTS

| | | |
|---|---|---|
| EP | 1484432 | 12/2004 |
| JP | 2000234177 | 8/2000 |
| JP | 2003171778 | 6/2003 |
| JP | 2005187925 | 7/2005 |
| WO | 2006/088519 | 8/2006 |

OTHER PUBLICATIONS

N.N. Voevodin et al., "Potentiodynamic evaluation of sol-gel coatings with inorganic inhibitors", Surface and Coatings Technology, Jan. 1, 2001, pp. 24-28, vol. 140, Amsterdam, NL.

* cited by examiner

*Primary Examiner* — Melvin C Mayes
*Assistant Examiner* — Stefanie Cohen
(74) *Attorney, Agent, or Firm* — Bachman & LaPointe, P.C.

(57) ABSTRACT

Trivalent chromium conversion coatings are provided on a metal substrate wherein the trivalent chromium conversion coating has a halogen content of 1 atom % maximum.

11 Claims, No Drawings

HALOGEN-FREE TRIVALENT CHROMIUM CONVERSION COATING

CROSS-REFERENCE TO RELATED APPLICATIONS

This application is the U.S. Divisional Application of Ser. No. 11/648,224 filed Dec. 28, 2006, now U.S. Pat. No. 7,989,078.

FIELD OF THE INVENTION

The present invention relates to processes for preparing corrosion-resistant substantially halogen-free trivalent chromium coatings.

PRIOR ART

Conversion coatings have been widely used in metal surface treatment for improved corrosion inhibition. Conversion coatings are applied through chemical reactions between the metal and the bath solution which converts or modifies the metal surface into a thin film with required functional properties. Conversion coatings are particularly useful in surface treatment of metals such a steel, zinc, aluminum and magnesium. In the past, chromate conversion coatings have proven to be the most successful conversion coatings for aluminum and magnesium. However, chromate conversion coatings used in the past generally contained hexavalent chromium. The use of hexavalent chromium results in potential hazardous working conditions for process operators and very high costs for waste disposal.

In order to overcome the problems associated with hexavalent chromium containing conversion coatings, there has been an effort to employ trivalent chromium conversion coatings which are far more acceptable from an environmental standpoint. U.S. Pat. Nos. 6,648,986 and 6,887,321 disclose trivalent chromium solutions for use in forming conversion coatings on metals. These known trivalent chromium processes contain a halogen in the bath solution as an activator. The resultant coating structure has a halogen incorporated therein at levels of 4 to 6 atomic %. It has been found that this level of halogen in the conversion coating may affect the corrosion life of the underlying metal substrate. The halogen results from the alkali metal hexahalogen zirconate bath constituent used in known process for producing the trivalent chromium conversion coating There is a need for processes for producing substantially halogen-free trivalent chromium conversion coatings on metal substrates.

SUMMARY OF THE INVENTION

Trivalent chromium conversion coatings are provided on a metal substrate wherein the trivalent chromium conversion coating has a halogen content of 1 atom % maximum. The present invention provides for processes for producing the trivalent chromium coatings which are halogen-free or contain 1 atomic % halogen maximum.

DETAILED DESCRIPTION OF PREFERRED EMBODIMENTS

A process for forming non-halogen containing trivalent chromium conversion coatings on metal substrates comprises the steps of (a) preparing a conversion coating solution comprising from 1 to 3 wt % soluble trivalent chromium salt such as chromium sulfate, and/or chromium nitrate from 1 to 3 wt % of a non-halogenated ligand compound of hafnium, zirconium, titanium or mixtures thereof, balance water; (b) adjusting the pH of the conversion coating solution to a range of between 1.5 to 4.5; (c) controlling the temperature of the conversion coating solution to a range of between 15 to 95° C.; and (d) contacting a metal substrate with the conversion coating solution to form a non-halogen containing trivalent chromium conversion coating on the substrate. For example, pH may be adjusted to a range of between 3 to 4 and the temperature of the conversion coating solution may be controlled to a temperature range of between 20 to 30° C. The metal substrate to be coated may be pretreated prior to contact with the coating solution with at least one of an alkaline solution and an acid solution. The non-halogenated ligand compound is selected from the group consisting of inorganic ligands, organic ligands and mixtures thereof. For example organic ligands may be selected from the group consisting of zirconium nitrate salts, zirconium sulfate salts, titanium nitrate salts, titanium sulfate salts, hafnium nitrate salts, hafnium sulfate salts and mixtures thereof. Further examples of organic ligands include those selected from the group consisting of zirconium oxlate, titanium oxlate, zirconium malonate, titanium malonate, hafnium oxlate, hafnium malonate, alkoxide compounds of these metals and mixtures thereof. The resulting trivalent chromium conversion coating is halogen free and comprises 2 to 12 atom % of zirconium, hafnium and/or titanium, 2 to 12 atom % Cr as Cr III with the balance essentially the metal of the substrate. A non-halogenated trivalent chromium conversion coating comprises 8 to 12 atom % of zirconium hafnium and/or titanium, 8 to 12 atom % Cr as Cr III and balance essentially oxygen and the metal of the substrate. The results in trivalent chromium coating should have a thickness of between 50 to 175 nanometers, usefully between 75 to 100 nanometers.

Another process for preparing a substantially halogen free trivalent chromium corrosion coating on a metal substrate comprises the steps of (a) preparing a conversion coating solution comprising from greater than zero to 5 wt % of a compound of titanium, zirconium and/or hafnium, greater than zero to 3 wt % chrome sulfate and/or chromium nitrate, up to 1 wt % sodium fluoride and/or potassium fluoride, balance water (b) adjusting the pH of the conversion coating solution to a range of between 1 to 6; and (c) contacting a metal substrate with the conversion coating solution to form a substantially halogen free trivalent conversion coating on the substrate wherein a halogen is present in an amount of up to 1 atom %. For example, the pH may be adjusted to a range of between 3 to 4. The metal substrate may be pretreated prior to contact with the coating solution with at least one of alkaline solution and an acid solution. The resulted conversion coating comprises 2 to 12 atom % zirconium, titanium and/or hafnium, 2 to 12 atom % Cr as Cr III, up to 1 atom % maximum of the halogen and balance essentially the metal of the substrate: For example, the conversion coating may comprise 8 to 12 atom % zirconium, titanium and/or hafnium, 8 to 12 atom % Cr as Cr III, up to 1 atom % maximum of the halogen and balance essentially the metal of the substrate. The coating has a thickness of between 50 to 175 nanometers, for example between 75 to 100 nanometers.

Another process for forming a non-halogen coating trivalent chromium coating on a metal substrate comprises the steps of (a) preparing a solution comprising 0.25 to 4.0 atomic % of titanium, zirconium and/or hafnium metal containing compounds, a source of trivalent chromium, a chelating agent and polyhydroxy alcohol; (b) heating the solution (40-80° C.) to form a polymer gel with entrapped trivalent chromium and metal compound; (c) controlling the pH of the polymer gel between 6.0-8.0; (d) contacting the metal substrate with the polymer gel at a temperature of between 10-80° C. to form a non-halogen containing trivalent chromium coating on the substrate. In accordance with this process, the metal containing compound is selected from the group consisting of hydrous oxides and/or alkoxides of the hafnium, titanium and/or zirconium. The coated substrate may be baked at a temperature of up to 120° C. The non-halogenated containing trivalent chromium conversion coating of the process comprises a wt. % composition ratio of 0.25-4.0 of a metal selected from the group consisting of zirconium, titanium, hafnium, and mixtures thereof/Cr as Cr (III). For example, the conversion coating may comprise an atomic composition ratio of 1:1 of a metal selected from the group consisting of zirconium, titanium, hafnium, and mixtures thereof: Cr as Cr (III).

Another process for forming non-halogen containing trivalent chromium coatings on metal substrates comprises (a) preparing a solution comprising a metal alkoxide compound of a metal selected from the group consisting of zirconium, titanium, hafnium, and mixtures thereof and chromium (III) acetate hydroxide or a chromium (III) inorganic salt in water; (b) polymerizing the solution to form a gel; (c) maintaining the temperature of the solution between 45-80° C.; and (d) contacting the metal substrate with the polymer gel between 10-80° C. (for example, room temperature) to form a non-halogen containing trivalent chromium coating on the substrate. The metal alkoxide comprises a metal isopropoxide compound. The solution may include propanol or acetylacetone. The coated substrate may be baked at a temperature of up to 120° C. The resultant non-halogenated containing trivalent chromium conversion coating comprises an atomic composition ratio of 0.25-4.0 of a metal selected from the group consisting of zirconium, titanium, hafnium, and mixtures thereof/Cr as Cr (III). For example, the conversion coating may comprise an atomic composition ratio of 1:1 of a metal selected from the group consisting of zirconium, titanium, hafnium, and mixtures thereof: Cr as Cr (III).

We have found that trivalent chromium coatings which are substantially free of a halogen and contain up to a maximum of 1 atomic % halogen exhibit superior corrosion properties when applied to metal substrates than conversion coatings of the prior art which employ higher content halogens in the solution baths from which the conversion coatings are prepared.

While the present invention has been described in the context of the specific embodiments, other unforeseeable alternatives, modifications and variations may become apparent to those skilled in the art having read the foregoing description. Accordingly, it is intended to embrace those alternatives, modifications and variations as fall within the broad scope of the appended claims.

What is claimed is:

1. A process for forming non-halogen containing trivalent chromium coatings on metal substrates comprising the steps of:

(a) preparing a solution comprising 0.25 to 4.0 atomic % of a metal compound selected from the group consisting of zirconium, titanium, hafnium, and mixtures thereof, a source of trivalent chromium, a chelating agent and polyhydroxy alcohol;

(b) heating the solution to a temperature of between 40-80° C. to form a polymer gel with entrapped trivalent chromium and a metal selected from the group consisting of zirconium, titanium, hafnium, and mixtures thereof;

(c) controlling the pH of the polymer gel between 6.0-8.0;

(d) contacting the metal substrate with the polymer gel at a temperature of between 10-80° C. to form a single layer conversion coating on the substrate wherein the single layer conversion coating consists of a non-halogen containing trivalent chromium conversion coating.

2. A process according to claim 1, wherein the metal compound is selected from the group consisting of hydrous oxides, alkoxides, and mixtures thereof.

3. A process according to claim 2, including baking the coated substrate at a temperature up to 120° C.

4. A process according to claim 2, wherein the non-halogenated containing trivalent chromium conversion coating comprises an atomic composition ratio of 0.25-4.0 of a metal selected from the group consisting of zirconium, titanium, hafnium, and mixtures thereof/Cr as Cr (III).

5. A process according to claim 4, wherein the conversion coating comprises an atomic composition ratio of 1:1 of a metal selected from the group consisting of zirconium, titanium, hafnium, and mixtures thereof: Cr as Cr (III).

6. A process for forming non-halogen containing trivalent chromium coatings on metal substrates comprising:

(a) preparing a solution comprising a metal alkoxide compound selected from the group consisting of zirconium, titanium, hafnium, and mixtures thereof and at least one of chromium (III) acetate hydroxide and a chromium (III) inorganic salt in water;

(b) polymerizing the solution to form a gel;

(c) maintaining the temperature of the solution between 45-80° C.; and (d) contacting the metal substrate with the polymer gel between 10-80°0 C. to form a single layer conversion coating on the substrate wherein the single layer conversion coating consists of a non-halogen containing trivalent chromium coating.

7. A process according to claim 6, wherein the metal alkoxide comprises a metal isopropoxide compound.

8. A process according to claim 7, including in the solution at least one of propanol and acetylacetone.

9. A process according to claim 6, including baking the coated substrate at a temperature up to 120° C.

10. A process according to claim 6, wherein the non-halogenated containing trivalent chromium conversion coating comprises an atomic composition ratio of 0.25-4.0 of a metal selected from the group consisting of zirconium, titanium, hafnium, and mixtures thereof/Cr as Cr (III).

11. A process according to claim 6, wherein the conversion coating comprises an atomic composition ratio of 1:1 of a metal selected from the group consisting of zirconium, titanium, hafnium, and mixtures thereof: Cr as Cr (III).

* * * * *